US008498762B2

(12) United States Patent
Wills et al.

(10) Patent No.: US 8,498,762 B2
(45) Date of Patent: Jul. 30, 2013

(54) METHOD OF PLANNING THE MOVEMENT OF TRAINS USING ROUTE PROTECTION

(75) Inventors: Mitchell Scott Wills, Melbourne, FL (US); Joanne Maceo, Rockledge, FL (US); Randall Markley, Melbourne, FL (US); Joel Kickbusch, Rockledge, FL (US); Erdem Telatar, Palm Bay, FL (US)

(73) Assignee: General Electric Company, Schenectady, NY (US)

( * ) Notice: Subject to any disclaimer, the term of this patent is extended or adjusted under 35 U.S.C. 154(b) by 1125 days.

(21) Appl. No.: 11/415,272

(22) Filed: May 2, 2006

(65) Prior Publication Data

US 2007/0260367 A1 Nov. 8, 2007

(51) Int. Cl.
*G08G 1/00* (2006.01)

(52) U.S. Cl.
USPC ..... 701/19; 701/117; 340/928

(58) Field of Classification Search
USPC ..... 701/69, 19, 117; 340/928
See application file for complete search history.

(56) References Cited

U.S. PATENT DOCUMENTS

| | | | | |
|---|---|---|---|---|
| 3,575,594 | A | | 4/1971 | Elcan |
| 3,734,433 | A | | 5/1973 | Metzner |
| 3,794,834 | A | | 2/1974 | Auer, Jr. et al. |
| 3,839,964 | A | | 10/1974 | Gayot |
| 3,895,584 | A | | 7/1975 | Paddison |
| 3,915,580 | A | * | 10/1975 | Kaufman ..... 404/1 |
| 3,944,986 | A | | 3/1976 | Staples |
| 4,099,707 | A | | 7/1978 | Anderson |
| 4,122,523 | A | | 10/1978 | Morse et al. |
| 4,361,300 | A | | 11/1982 | Rush |
| 4,361,301 | A | | 11/1982 | Rush |
| 4,610,206 | A | | 9/1986 | Kubala et al. |
| 4,669,047 | A | | 5/1987 | Chucta |
| 4,750,129 | A | * | 6/1988 | Hengstmengel et al. ..... 701/117 |
| 4,791,871 | A | | 12/1988 | Mowll |
| 4,843,575 | A | | 6/1989 | Crane |
| 4,883,245 | A | | 11/1989 | Erickson, Jr. |
| 4,926,343 | A | | 5/1990 | Tsuruta et al. |
| 4,937,743 | A | | 6/1990 | Rassman et al. |
| 5,038,290 | A | | 8/1991 | Minami |
| 5,063,506 | A | | 11/1991 | Brockwell et al. |
| 5,177,684 | A | | 1/1993 | Harker et al. |
| 5,222,192 | A | | 6/1993 | Shafer |
| 5,229,948 | A | | 7/1993 | Wei et al. |

(Continued)

FOREIGN PATENT DOCUMENTS

| | | |
|---|---|---|
| CA | 2057039 | 12/1990 |
| CA | 2066739 | 2/1992 |

(Continued)

OTHER PUBLICATIONS

Crone, et al., "Distributed Intelligent Network Management for the SDI Network," IEEE, 1991, pp. 722-726, MILCOM '91.

(Continued)

*Primary Examiner* — Tuan C. To
(74) *Attorney, Agent, or Firm* — GE Global Patent Operation; John A. Kramer

(57) ABSTRACT

A method of planning the movement of plural trains over a train network utilizing route protection for the route immediately ahead of a train to avoid undesirable changes to the planned route of the train.

13 Claims, 1 Drawing Sheet

U.S. PATENT DOCUMENTS

| | | | | |
|---|---|---|---|---|
| 5,237,497 | A | 8/1993 | Sitarski | |
| 5,265,006 | A | 11/1993 | Asthana et al. | |
| 5,289,563 | A | 2/1994 | Nomoto et al. | |
| 5,311,438 | A | 5/1994 | Sellers et al. | |
| 5,331,545 | A | 7/1994 | Yajima et al. | |
| 5,332,180 | A | 7/1994 | Peterson et al. | |
| 5,335,180 | A | 8/1994 | Takahashi et al. | |
| 5,365,516 | A | 11/1994 | Jandrell | |
| 5,390,880 | A | 2/1995 | Fukawa et al. | |
| 5,420,883 | A | 5/1995 | Swensen et al. | |
| 5,437,422 | A | 8/1995 | Newman | |
| 5,463,552 | A | 10/1995 | Wilson et al. | |
| 5,467,268 | A | 11/1995 | Sisley et al. | |
| 5,487,516 | A | 1/1996 | Murata et al. | |
| 5,541,848 | A | 7/1996 | McCormack et al. | |
| 5,623,413 | A * | 4/1997 | Matheson et al. | 701/117 |
| 5,745,735 | A | 4/1998 | Cohn et al. | |
| 5,794,172 | A * | 8/1998 | Matheson et al. | 701/117 |
| 5,823,481 | A | 10/1998 | Gottschlich | |
| 5,825,660 | A | 10/1998 | Cagan et al. | |
| 5,828,979 | A * | 10/1998 | Polivka et al. | 701/117 |
| 5,850,617 | A | 12/1998 | Libby | |
| 6,032,905 | A | 3/2000 | Haynie | |
| 6,115,700 | A | 9/2000 | Ferkinhoff et al. | |
| 6,125,311 | A | 9/2000 | Lo | |
| 6,135,396 | A * | 10/2000 | Whitfield et al. | 246/182 R |
| 6,144,901 | A | 11/2000 | Nickles et al. | |
| 6,154,735 | A | 11/2000 | Crone | |
| 6,250,590 | B1 | 6/2001 | Hofestadt et al. | |
| 6,351,697 | B1 | 2/2002 | Baker | |
| 6,377,877 | B1 | 4/2002 | Doner | |
| 6,393,362 | B1 | 5/2002 | Burns | |
| 6,405,186 | B1 | 6/2002 | Fabre et al. | |
| 6,459,964 | B1 * | 10/2002 | Vu et al. | 701/19 |
| 6,459,965 | B1 | 10/2002 | Polivka et al. | |
| 6,546,371 | B1 * | 4/2003 | Doner | 705/7.26 |
| 6,587,738 | B1 * | 7/2003 | Belcea | 700/33 |
| 6,587,764 | B2 | 7/2003 | Nickles et al. | |
| 6,637,703 | B2 | 10/2003 | Matheson et al. | |
| 6,641,090 | B2 * | 11/2003 | Meyer | 246/122 R |
| 6,654,682 | B2 | 11/2003 | Kane et al. | |
| 6,766,228 | B2 | 7/2004 | Chirescu | |
| 6,789,005 | B2 | 9/2004 | Hawthorne | |
| 6,799,097 | B2 | 9/2004 | Villarreal Antelo | |
| 6,799,100 | B2 | 9/2004 | Burns | |
| 6,853,889 | B2 | 2/2005 | Cole | |
| 6,856,865 | B2 | 2/2005 | Hawthorne | |
| 7,006,796 | B1 | 2/2006 | Hofmann et al. | |
| 7,212,134 | B2 * | 5/2007 | Taylor | 340/901 |
| 7,425,903 | B2 * | 9/2008 | Boss et al. | 340/902 |
| 2003/0105561 | A1 | 6/2003 | Nickles et al. | |
| 2003/0183729 | A1 | 10/2003 | Root et al. | |
| 2004/0010432 | A1 | 1/2004 | Matheson et al. | |
| 2004/0034556 | A1 | 2/2004 | Matheson et al. | |
| 2004/0093196 | A1 | 5/2004 | Hawthorne | |
| 2004/0093245 | A1 | 5/2004 | Matheson et al. | |
| 2004/0267415 | A1 | 12/2004 | Lacote et al. | |
| 2005/0107890 | A1 | 5/2005 | Minkowitz et al. | |
| 2005/0192720 | A1 | 9/2005 | Christie et al. | |
| 2006/0074544 | A1 * | 4/2006 | Morariu et al. | 701/117 |
| 2008/0004794 | A1 * | 1/2008 | Horvitz | 701/200 |

FOREIGN PATENT DOCUMENTS

| | | |
|---|---|---|
| CA | 2046984 | 6/1992 |
| CA | 2112302 | 6/1994 |
| CA | 2158355 | 10/1994 |
| EP | 0108363 | 5/1984 |
| EP | 0193207 | 9/1986 |
| EP | 0341826 | 11/1989 |
| EP | 0554983 | 8/1993 |
| FR | 2692542 | 12/1993 |
| GB | 1321053 | 6/1973 |
| GB | 1321054 | 6/1973 |
| JP | 3213459 | 9/1991 |
| WO | WO 90/03622 | 4/1990 |
| WO | WO 93/15946 | 8/1993 |

OTHER PUBLICATIONS

Ghedira, "Distributed Simulated Re-Annealing for Dynamic Constraint Satisfaction Problems," IEEE 1994, pp. 601-607.

Hasselfield, et al., "An Automated Method for Least Cost Distribution Planning," IEEE Transactions on Power Delivery, vol. 5, No. 2, Apr. 1990, 1188-1194.

Herault, et al., "Figure-Ground Discrimination: A Combinatorial Optimization Approach," IEEE Transactions on Pattern Analysis & Machine Intelligence, vol. 15, No. 9, Sep. 1993, 899-914.

Igarashi, "An Estimation of Parameters in an Energy Fen Used in a Simulated Annealing Method," IEEE, 1992, pp. IV-180-IV-485.

Komaya, "A New Simulation Method and its Application to Knowledge-based Systems for Railway Scheduling," May 1991, pp. 59-66.

Puget, "Object Oriented Constraint Programming for Transportation Problems," IEEE 1993, pp. 1-13.

Sasaki, et al., "Development for a New Electronic Blocking System," QR of RTRI, vol. 30, No. 4, Nov. 1989, pp. 198-201.

Scherer, et al., "Combinatorial Optimization for Spacecraft Scheduling," 1992 IEEE International Conference on Tolls with AI, Nov. 1992, pp. 120-126.

Watanabe, et al., "Moving Block System with Continuous Train Detection Utilizing Train Shunting Impedance of Track Circuit," QR of RTRI, vol. 30, No. 4, Nov. 1989, pp. 190-197.

* cited by examiner

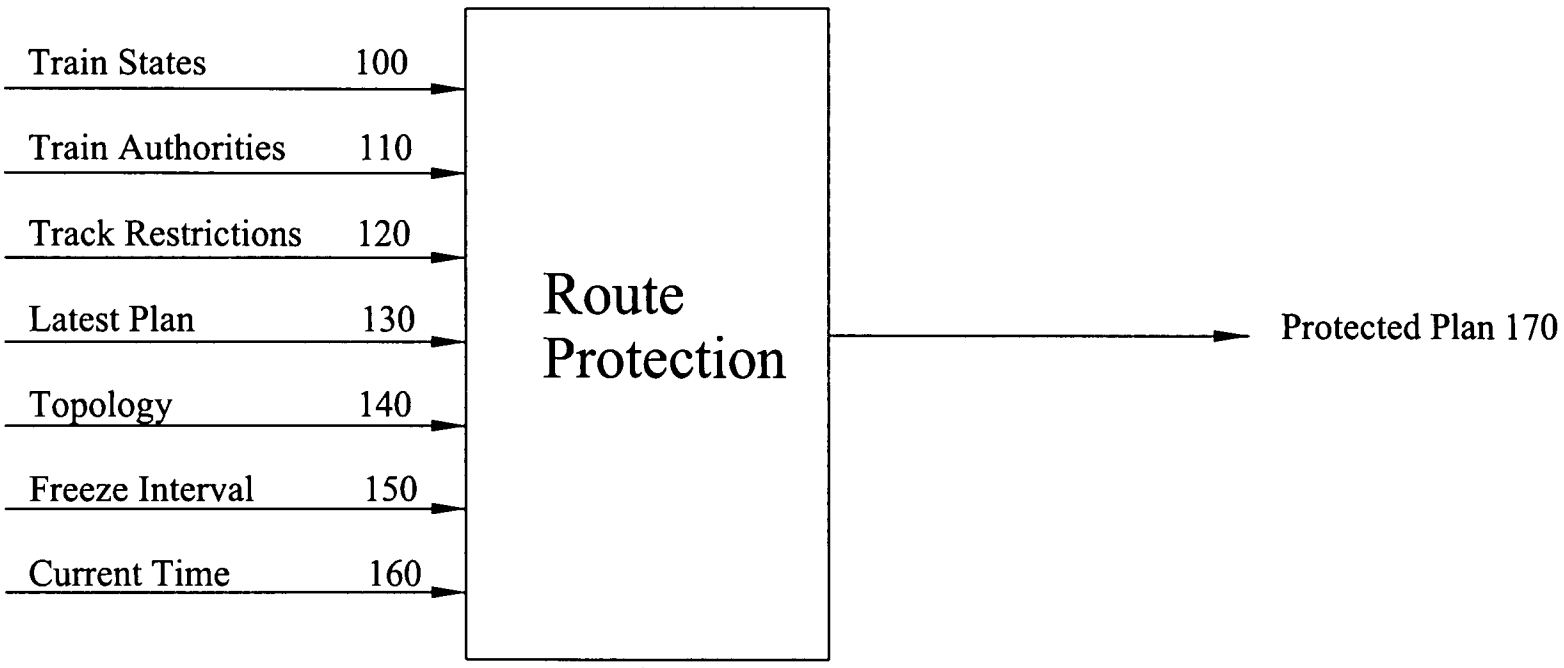
Train States 100
Train Authorities 110
Track Restrictions 120
Latest Plan 130
Topology 140
Freeze Interval 150
Current Time 160
Route Protection
Protected Plan 170

METHOD OF PLANNING THE MOVEMENT OF TRAINS USING ROUTE PROTECTION

RELATED APPLICATIONS

The present application is being filed concurrently with the following related applications, each of which is commonly owned:

U.S. application Ser. No. 11/415,273 entitled "Method of Planning Train Movement Using a Front End Cost Function";

U.S. application Ser. No. 11/415,274 entitled "Method and Apparatus for Planning Linked Train Movements; and U.S. application Ser. No. 11/415,275 entitled "Method and Apparatus for Planning the Movement of Trains Using Dynamic Analysis"; and The disclosure of each of the above referenced applications including those concurrently filed herewith is hereby incorporated herein by reference.

BACKGROUND OF THE INVENTION

The present invention relates to the scheduling of movement of plural units through a complex movement defining system, and in the embodiments disclosed, to the scheduling of the movement of freight trains over a railroad system utilizing route protection.

Systems and methods for scheduling the movement of trains over a rail network have been described in U.S. Pat. Nos. 6,154,735, 5,794,172, and 5,623,413, the disclosure of which is hereby incorporated by reference.

As disclosed in the referenced patents and applications, the complete disclosure of which is hereby incorporated herein by reference, railroads consist of three primary components (1) a rail infrastructure, including track, switches, a communications system and a control system; (2) rolling stock, including locomotives and cars; and, (3) personnel (or crew) that operate and maintain the railway. Generally, each of these components are employed by the use of a high level schedule which assigns people, locomotives, and cars to the various sections of track and allows them to move over that track in a manner that avoids collisions and permits the railway system to deliver goods to various destinations.

As disclosed in the referenced patents and applications, a precision control system includes the use of an optimizing scheduler that will schedule all aspects of the rail system, taking into account the laws of physics, the policies of the railroad, the work rules of the personnel, the actual contractual terms of the contracts to the various customers and any boundary conditions or constraints which govern the possible solution or schedule such as passenger traffic, hours of operation of some of the facilities, track maintenance, work rules, etc. The combination of boundary conditions together with a figure of merit for each activity will result in a schedule which maximizes some figure of merit such as overall system cost.

As disclosed in the referenced patents and applications, and upon determining a schedule, a movement plan may be created using the very fine grain structure necessary to actually control the movement of the train. Such fine grain structure may include assignment of personnel by name as well as the assignment of specific locomotives by number, and may include the determination of the precise time or distance over time for the movement of the trains across the rail network and all the details of train handling, power levels, curves, grades, track topography, wind and weather conditions. This movement plan may be used to guide the manual dispatching of trains and controlling of track forces, or provided to the locomotives so that it can be implemented by the engineer or automatically by switchable actuation on the locomotive.

The planning system is hierarchical in nature in which the problem is abstracted to a relatively high level for the initial optimization process, and then the resulting course solution is mapped to a less abstract lower level for further optimization. Statistical processing is used at all levels to minimize the total computational load, making the overall process computationally feasible to implement. An expert system is used as a manager over these processes, and the expert system is also the tool by which various boundary conditions and constraints for the solution set are established. The use of an expert system in this capacity permits the user to supply the rules to be placed in the solution process.

In prior art movement planners, plans are periodically generated which result in an optimized planned movement of the trains. Typically, the actual movement of the trains is monitored in some manner, and if deviations to the planned movement occur, a replanning cycle occurs to make modifications to the movement plan to account for the deviations.

One problem with the typical optimizing movement planner is that because the railroad environment is dynamic, the detailed plan for a train (e.g., it's meet and pass locations) may change each time the movement plan is calculated. While the changed route for a train may be optimal in some sense, changes to the movement plan for a train are undesirable operationally if they affect the route immediately ahead of the train. For example, the planner may have planned a specific train meet, and the dispatcher may have taken actions in reliance on the planned train meet. If the meet is changed at the last minute due to the calculation of a marginally better plan, the dispatcher may not have sufficient time to react to the new train meet and the undisclosed plans of the dispatcher may be disrupted.

This problems stems from the movement planner continually striving to produce the most optimum movement plan. However, if multiple routes are almost equally optimal, the slightest environmental change may cause the planner to shift from one route to the other route, resulting in thrashing, i.e., the repeated change back and forth between alternate routes. This is very problematic for the dispatcher who may need to take specific actions based in the route chosen.

Thus, while last minute route changes are desirable when they result in a clearly superior alternate, i.e., the previous route has become impassable due to a track block, plan changes immediately head of the train for a nominally optimal route are clearly undesirable.

The present disclosure avoids these problems found in the prior art by protecting the route immediately ahead of a train to avoid trashing that would otherwise occur.

SUMMARY OF THE INVENTION

These and many other objects and advantages of the present invention will be readily apparent to one skilled in the art to which the invention pertains from a perusal of the claims, the appended drawings, and the following detailed description of the embodiments.

BRIEF DESCRIPTION OF THE DRAWING

FIG. 1 is a simplified pictorial representation of one embodiment of a method utilizing route protection.

DETAILED DESCRIPTION

In the present disclosure, a method of determine whether to protect a route, and the extent of the route protection is utilized to prevent an optimizing movement planner from thrashing while searching for the most optimal solution. FIG. 1 represents the inputs used to determine whether and to what extent route protection is need. Train states 100 provides the current state of the train and provides the starting point for determining the extent of route protection. Train authorities 110 includes identification of whether a train is under CTC or form based control which affects the extent of route protection. Track restrictions 120 assist n the extent of route protection as restrictions affect the available routes and solutions. The latest plan 130 together with the train state provides feedback as to actual operation against the planned movement of the train. Topology 140 provides input which directly impact train handling characteristics. Freeze interval 150 and the current time defines how long the route protection should be in place. The protected plan 170 is provided which places a temporal or geographical restriction on changes to the trains planned route.

The inputs are evaluated to determine whether and to what extent a train's plan should be protected. Protecting too much limits the ability to repair or reschedule the movement of the train. Protecting too little causes plan instability and may cause the auto-router to clear signals unnecessarily. In congested areas, protecting too much can reduce the number of alternatives or may cause deadlocks. In form based authority areas or CTC areas, the route protection can be geographic in scope. In other areas, the route protection may be implemented as a function of time.

If the inputs are evaluated to provide that a clearly more optimal alternate plan is available, no route protection may be implemented at all. For example, in cases where a planned route becomes unavailable alternate route immediately ahead of the train may be more desirable. Where the inputs result in an alternate plan that does not exceed a predetermined threshold, the inputs are used to determine the extent of route protection that should be accorded the train.

In operation, the route protection can be provided when a train deviates from its planned route and a new movement plan is generated which is not sufficiently better to warrant switching to the new movement plan. In this case, a portion of the original movement plan immediately ahead of the train may be protected and the remainder of the plan may be modified to account for deviations. In one aspect the method could include providing a first movement plan for a train, monitoring the actual movement of the train, evaluating the actual movement of the train against the planned movement, providing a second movement plan for train to account for deviations of the actual train movement from the first movement plan, evaluating the first movement plan against the second movement plan, preventing modification to a first portion of the first movement plan if the difference between the first and second movement plan is less than a predetermined threshold, and modifying a second portion of the first movement plan to account for the deviations. In the case of form based movement authority control or in areas of CTC, the first portion of the first movement plan may represent a geographical area immediately ahead of the train. In other areas, the first portion of the movement plan is a period of time.

In another aspect, when modifications to the movement plan are needed, the area in front of the train is protected from any modification. For example, the aspect could be implemented by providing a first movement plan for a train, monitoring the actual movement of the train, evaluating the actual movement of the train against the planned movement including the current location of the train at the current time, modifying the first movement plan to account for deviations of the actual train movement from the first movement plan, and preventing modification of the first movement plan for a predetermined distance from the location of the train. The predetermined distance may a function of a block control of the train or of a movement authority issued for the train.

In another embodiment, prior to implementing route protection, an analysis of the planned route to be protected is performed and adjustments to the plan may be made taking into account the current status of the train and the planned route. Once the route protection is in place, no further modifications to the plan for the protected portion may be made, and thus minor adjustments just prior to route protection are sometimes desirable. For example, if a train is currently behind its planned movement, an increase in planned velocity may be desirable before implementing route protection. Additionally it may be useful to search for new track restriction or track blocks in the area to be protected prior to implementation of route protection in order to take these restrictions and blocks into account.

The method of protecting the route immediately ahead of a train may be implemented as described herein using computer usable medium having a computer readable code executed by special purpose or general purpose computers.

While embodiments of the present invention have been described, it is understood that the embodiments described are illustrative only and the scope of the invention is to be defined solely by the appended claims when accorded a full range of equivalence, many variations and modifications naturally occurring to those of skill in the art from a perusal hereof.

What is claimed:

1. A method of planning the movement of plural trains over a rail network comprising:

(a) providing a first movement plan for a train, said first movement plan including a plurality of portions;

(b) monitoring the actual movement of the train;

(c) evaluating the actual movement of the train in a computer system against the planned movement;

(d) providing a second movement plan for the train to account for deviations of the actual train movement from the first movement plan;

(e) evaluating the first movement plan against the second movement plan;

(f) preventing modification to a first portion of the first movement plan if the difference between the first and second movement plan is less than a predetermined threshold; and (g) modifying a second portion of the first movement plan to account for the deviations.

2. The method of claim 1 wherein the first portion of the first movement plan represents a geographical area.

3. The method of claim 1 wherein the first portion of the first movement plan is a period of time.

4. The method of claim 2 wherein the geographical area is chosen as a function of the track authorities issued for the train.

5. The method of claim 2 wherein the second portion of the first movement plan represents a geographical area.

6. The method of claim 3 wherein the second portion of the first movement plan is a period of time.

7. A method of planning the movement of plural trains over a rail network comprising:

(a) providing a first movement plan for a train;

(b) monitoring the actual movement of the train;

(c) evaluating the actual movement of the train in a computer system against the planned movement including the current location of the train at the current time;

(d) modifying the first movement plan to account for deviations of the actual train movement from the first movement plan; and (e) preventing modification of the first movement plan for a predetermined distance from the location of the train.

8. The method of claim 7 wherein the predetermined distance is a function of a block control of the train.

9. The method of claim 7 wherein the predetermined distance is a function of a movement authority issued for the train.

10. A method of planning the movement of plural trains over a rail network comprising:

(a) providing a first movement plan for a train, said first movement plan including a plurality of portions;

(b) monitoring the actual movement of the train;

(c) evaluating the actual movement of the train in a computer system against the first movement plan;

(d) calculating deviations representing differences between the actual movement and the first movement plan;

(e) preventing modification to a first portion of the first movement plan immediately ahead of the train as function of the deviations; and (f) modifying a second portion of the first movement plan to account for the deviations.

11. The method of claim 10 wherein said first portion of the first movement plan represents a geographical area.

12. The method of claim 10 wherein said first portion of the first movement plan is a period of time.

13. The method of claim 11 wherein the geographical area is chosen as a function of the track authorities issued for the train.

* * * * *